US005090166A

United States Patent [19]

Johnson et al.

[11] Patent Number: 5,090,166

[45] Date of Patent: Feb. 25, 1992

[54] RECTILINEAR BUILDING STRUCTURE

[75] Inventors: Donald L. Johnson, Independence; Roger A. LaBoube, Rolla, both of Mo.; Suresh C. Satsangi, Lenexa, Kans.

[73] Assignee: Butler Manufacturing Company, Del.

[21] Appl. No.: 601,399

[22] Filed: Oct. 23, 1990

[51] Int. Cl.[5] ..... E04C 3/292

[52] U.S. Cl. ..... 52/167 CB; 52/693; 52/638; 403/217

[58] Field of Search ..... 52/167 R, 167 CB, 167 DF, 52/393, 573, 634, 638, 693, 655, 146

[56] References Cited

U.S. PATENT DOCUMENTS

| | | | |
|---|---|---|---|
| 3,349,418 | 10/1967 | Hein . | |
| 3,691,712 | 9/1972 | Bowling et al. . | |
| 3,793,790 | 2/1974 | Love et al. . | |
| 3,985,459 | 10/1976 | Gilb | 52/693 X |
| 4,409,765 | 10/1983 | Pall . | |
| 4,605,106 | 8/1986 | Fyfe et al. . | |
| 4,615,157 | 10/1986 | Murray . | |
| 4,727,695 | 3/1988 | Kemeny . | |
| 4,910,929 | 3/1990 | Scholl . | |

FOREIGN PATENT DOCUMENTS

| | | | |
|---|---|---|---|
| 3038919 | 5/1982 | Fed. Rep. of Germany | 52/393 |
| 9529 | 1/1981 | Japan | 52/167 |
| 1296708 | 3/1987 | U.S.S.R. | 52/167 CB |

*Primary Examiner*—Richard E. Chilcot, Jr.
*Assistant Examiner*—Wynn Wood
*Attorney, Agent, or Firm*—Shoemaker and Mattare, Ltd.

[57] ABSTRACT

An improved rectilinear building structure using diagonal tension members to resist racking to improve the tolerance of transitory transverse loads such as those that are produced by seismic occurrences. The improvement comprises placing a resilient pad in compression between at least one end of a tension member and a structural member whereby the resilient pad is compressed when the tension member is under tension so that the resilient pad deforms under the transitory transverse load thereby increasing the ductility of the structure before fracture of the tension member occurs.

8 Claims, 2 Drawing Sheets

RECTILINEAR BUILDING STRUCTURE

The invention relates to improvements in rectilinear building frame structures, which use diagonal tension members to resist racking, to improve tolerance to transitory transverse overloads.

BACKGROUND OF THE INVENTION

It is known to use tension members, such as a roof and sidewall tension rods, to brace an industrial or commercial building to enable the building to withstand normal transverse loading (e.g., wind loads) as well as substantial seismic events. The tension members interconnect various structural members to resist "racking" (i.e., diagonal collapse) of the building when subjected to such loads. However, one drawback associated with the known bracing systems is that the bracing, or tension members, are attached to the structure by a fixed non-yielding connection. As a result, substantially all of the transverse loads, tending to cause "racking", must be absorbed by the tension members immediately as the load is applied to the building. If a tension member is subjected to a load beyond its yield strength, that tension member can readily extend to fracture with resulting potential catastrophic failure of the building. Consequently, the physical properties, i.e., its ductility, yield strength, and elastic limit, which contributes to plastic deformation characteristics of the material from which the tension member is made are important design considerations for ensuring that a building is able to withstand normal transverse loads. Materials having both high strengths and ductility have been preferred as they are able to withstand greater displacement before fracturing and thereby help to ensure that damage to the structure, as well as its contents, is minimized.

The Applicant is aware of U.S. Pat. No. 3,349,418, No 3,691,712, No. 3,793,790, No. 4,409,765, No. 4,605,106, No. 4,615,157, No. 4,727,695 and No. 4,910,929. None of these patents are particularly directed to increasing the transitory transverse overload bearing ability of diagonal tension rod reinforced rectilinear building structures to improve survival of, for example, substantial seismic events.

SUMMARY OF THE INVENTION

Therefore, the primary objective of the invention is to provide an improved building structure including an improved connection for a side wall and/or a roof tension member to a rectilinear support structure whereby the transitory loading required for catastrophic failure of the structure to occur is significantly increased.

Another objective of the invention is to provide a relatively inexpensive, simple and compact connection of the tension members to the support structure.

A further objective of the invention is to provide resilient means in compression between at least one end of a tension member and a structural member to increase the transitory load the structure can withstand before that tension member fractures.

According to the present invention, a diagonal tension brace is connected to a structural member by a connector comprising a fixture having means for connection to the brace, and a face for mounting to one surface of the structural member, and a backing plate and a resilient pad for mounting on the opposite side of the structural member. Fasteners passing through aligned holes in the fixture, the structural member, the pad and the backing plate maintain the pad in compression. The pad bears the entire normal component of the brace load. When transitory loads occur, the pad may compress further, reducing peak loading and deadening shocks.

The resilient pad acts as an absorber, isolating the tension rod from peak loads it would otherwise experience during the application of transitory transverse loads to the building by, for example, a seismic event. Upon the application of these transitory transverse loads, the resilient pad resiliently deforms and, due to its internal friction and damping, absorbs a significant portion of the energy generated by the application of that transitory transverse load thereby delaying the transmission of that energy to the tension rod. The resilient pad is effective in reducing the rate of transmission of the energy generated by a transitory transverse load, received by the building in a relatively brief period, to the tension rod, with the consequence that the energy created by the transitory transverse load is applied to the tension rod over a longer period of time, with the consequent reduction in the maximum stress which the tension rod will experience. Thus, it can be seen that use of such resilient pad/tension rod combinations can significantly improve the building's ability to withstand significant seismic events in a ductile manner without exceeding the tension rod's fracture strength, which fracture could well lead to catastrophic destruction of the building.

BRIEF DESCRIPTION OF THE DRAWINGS

The invention will now be described, by way of example, with reference to the accompanying drawings, in which.

DESCRIPTION OF THE PREFERRED EMBODIMENT

Figure 1:
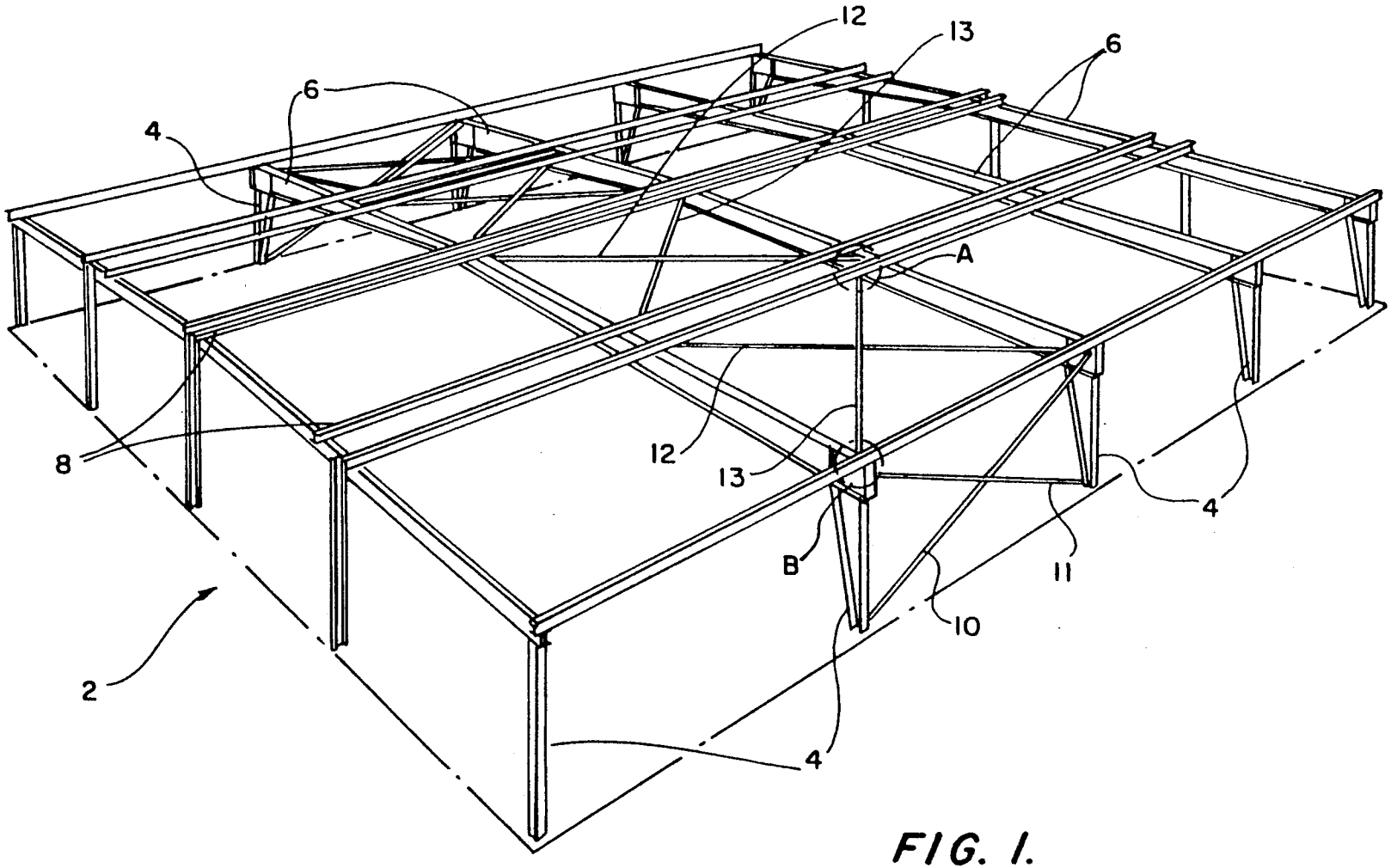
FIG. 1 is a diagrammatic perspective view of a structure according to the present invention.

Turning first to FIG. 1, a rectilinear structure 2 comprises a plurality of support columns 4 located in spaced relationship to define the perimeter of the structure 2. The support columns 4 extend substantially normal to the ground surface and may be supported by a concrete foundation or footing, as is well known in the art. A plurality of roof beams 6 extend between, and are supported by, respective pairs of opposed support columns 4. The roof beams 6, in turn, support a plurality of transverse, spaced apart roof support members or rafters 8 which support roofing (not shown), for example, fiberglass or metal panels.

At least two adjacent support columns 4, for example, in the middle or intermediate section of the building, are interconnected by a pair of diagonally extending sidewall tension rods 10, 11 crossing one another in a vertical plane. Sidewall tension rod 10 of these interconnects one end of a roof beam 6 supported by a first support column with the bottom portion of a second support column, while sidewall tension rod 11 interconnects one end of a second roof beam 6 supported by the second support column with the bottom portion of the first support column.

For further stabilizing the structure, at least two adjacent roof beams 6, for example, in the middle or intermediate section of the building, are interconnected with at least one pair of diagonally extending roof tension rods 12, 13 crossing one another in a horizontal plane. A first tension rod 12 of these interconnects the end portion of one roof beam 6 with an intermediate portion of another roof beam 6, while the second roof tension rod 13 interconnects the end portion of the second roof beam with an intermediate portion of the first roof beam. If desired, additional diagonal or crossed pairs of sidewall or roof tension rods can interconnect further columns and roof beams to provide added stability for the building.

As can be seen in FIG. 1, there are two opposed crossed pairs of sidewall tension rods 10, 11 (one pair interconnecting adjacent intermediate support columns on each of two opposed sides of the building) and four contiguous pairs of crossed roof tension rods 12, 13 extending between an intermediate pair of the roof beams 6 along their entire length. It will also be appreciated that diagonal tension rods may be used to reinforce building walls normal to those described above and that the actual crossing of the tension rods is unnecessary so long as the tension rods act to reinforce the structure against racking in all desired directions. The improved connection of the tension rods to the support column and/or the roof beam will be described in detail hereinafter with reference to FIGS. 2 and 3.

Figure 2:
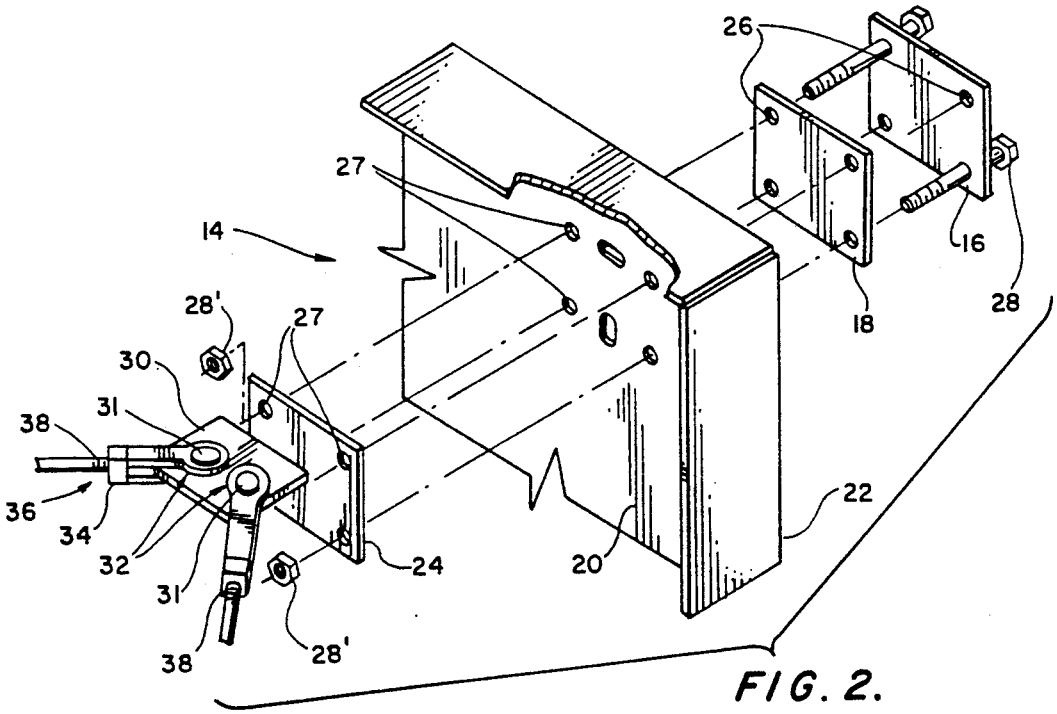
FIG. 2 is a fragmentary enlarged view of area A of FIG. 1 showing one form of connection device used in the present invention.

Turning now to FIG. 2, the connection device 14, for connecting roof tension rods to a support structure will now be described in detail. The device comprises a backing plate 16 disposed on one of a web portion 20 of a support member 22 (column or beam 4 or 6 of FIG. 1) with a resilient pad 18 positioned therebetween. A front plate 24 is attached to the opposite side of the support structure 22. A clip or flange member 30, lying in a plane extending essentially normal to the front plate 24 and horizontal to the ground, is securely affixed to a front surface to the front plate 24 by welding or other suitable attachment means. The front and back plates and the resilient pad each have four holes 26 which coincide with four holes 27 provided in the web portion 20. Four bolts 28 (only two of which are shown) passing through the holes 26, 27 of the backing plate 16, the resilient pad 18, the web portion 20 and the front plate 24, are secured by nuts 28' to fasten the device 14 to the support member 22.

The flange member 30 is provided with two spaced apart pivot holes 32, each supporting a clevis 34. Each clevis comprises a base portion and a pair of parallel legs which are each provided with a clevis pin receiving aperture located remote from the base. Each clevis is connected by its connection apertures to the respective hole 32 by a clevis pin 31, while the base of the U-shaped member has a threaded opening 36 for engaging a threaded end 38 of a roof tension rod 12 or 13.

Figure 3:
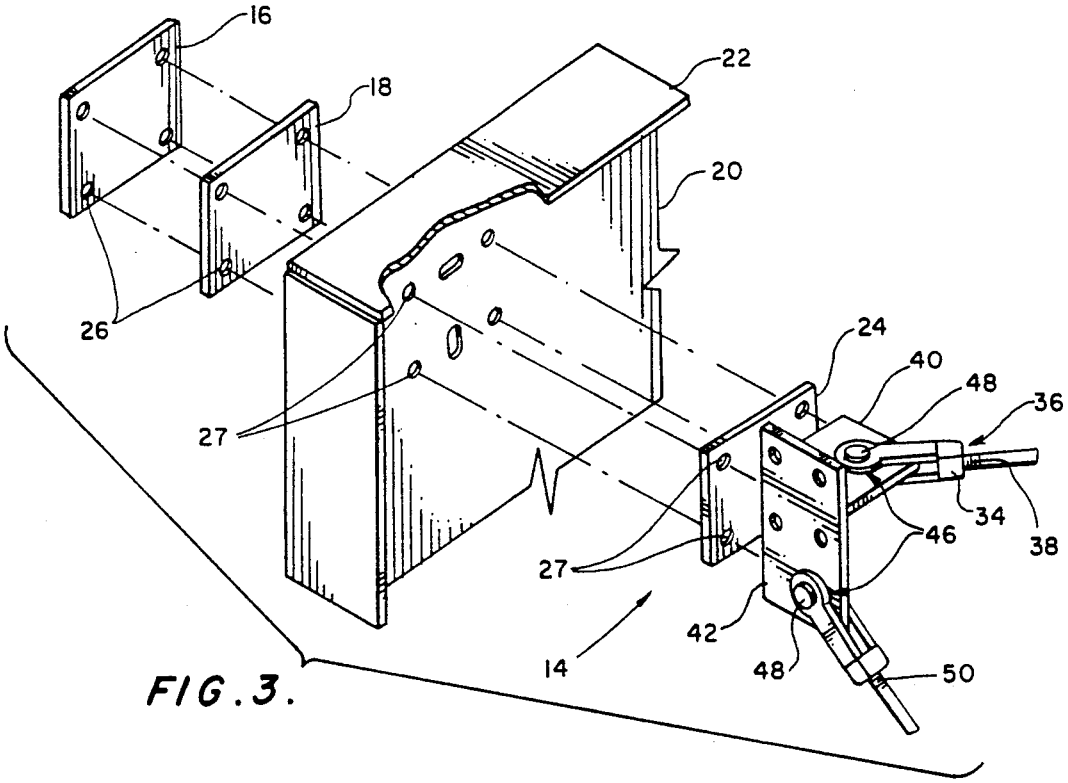
FIG. 3 is a fragmentary enlarged view of area B of FIG. 1 showing another form of the connection device used in the present invention.

FIG. 3 depicts a variation of the connection device 14 which differs little, in principle, from that shown in FIG. 2. The major difference is that the single flange member 30 is replaced with a pair of clip or flange members 40, 42 arranged normal to one another and the front plate 24, one flange member being parallel with the ground and other being perpendicular to the ground when installed. Both members are securely affixed to each other, and to the front surface of the front plate 24 by welding or other suitable attachment means. Each flange member 40, 42 is provided with a pivot hole 46. The connection apertures of each clevis 34 are connected to a respective hole 46 by a clevis pin 48, while the base of the clevis 34 has a threaded opening 36 for engaging a threaded end 50 or 38 of the sidewall or the roof tension rod 10, 11 or 12, 13, respectively.

The resilient pad 18 is preferably made of elastomeric material, such as neoprene or natural rubber, or another similar material having energy absorbing qualities and having a durometer of about 70 (type A) at 70° F., and a minimum tensile strength of about 3500 psi. A pad measuring 6 inches by 6 inches, with a thickness of about 1 inch, provides a modulus of about 3.6 ksi at 55° F. The hardness and/or thickness of the resilient pad can be varied, as necessary, so that the pad provides the necessary energy absorption. By utilizing a resilient pad as part of the connection device, the building structure is able to withstand greater transient transverse overloads, such as substantial seismic loads, without a tension rod fracture with the consequent possible racking of the structure.

The roof and tension members typically comprise members manufactured from steel or other suitable metals and have a diameter from about 0.5–1.5 inches. Non-circular tension members (e.g., angle sections) may be used as well.

When a building is subjected to a transitory transverse load, the resilient pads compress and absorb a substantial portion of the energy created by that load to thereby reduce the instantaneous stress experienced by the tension rods. The resilient pads are effective in delaying transmission of the energy of the transitory load, received by the building in a relatively brief period, and of transmitting that energy over a relatively longer period. This enhances the ductile performance of the tension rods subjected to under such transitory loads, such as could occur during a seismic occurrence or the like.

Since certain changes may be made in the above described connection arrangement and method without departing from the spirit and scope of the invention herein involved, it is intended that all subject matter contained in the above description or shown in the accompanying drawings shall be interpreted as being illustrative of the inventive concept and not limiting thereof.

We claim:

1. A building frame formed from vertical and horizontal structural members, independent diagonal tension members for resisting racking of the building under transverse loads, and connectors for joining ends of the diagonal members to the structural members, wherein each of the connectors comprises a backing plate facing one surface of one of the structural members, an elastomeric pad between the backing plate and said surface, and means for transferring tension loads in the respective diagonal member to said backing plate so as to compress said elastomeric pad, whereby said pad may compress further during transitory overloading of the frame, thereby increasing the deformability of the structure without exceeding the elastic limit of the tension members.

2. The invention of claim 1, wherein said transferring means comprises a bracket including a base plate, and means affixed to said base plate for joining one end of at least one of said diagonal members to said bracket, said bracket being mounted on one side of a respective structural member, and said backing plate and resilient element being mounted on the opposite side thereof, and at least one fastener for interconnecting said backing plate and said base plate.

3. The invention of claim 2, wherein one of the tension members extends diagonally of the rectilinear structure in a vertical plane and another of the tension members extends diagonally of the rectilinear structure in a horizontal plane, each of said tension members having one end thereof attached to one of said brackets.

4. The invention of claim 3, wherein said attaching means comprises a front plate having a flange permanently affixed thereto and extending substantially normal therefrom, said tension member having a clevis secured to its end, and said flange having a through hole, and a clevis pin for connecting said clevis to said flange at said hole.

5. The invention of claim 4, wherein said bracket comprises a pair of plates arranged normal to one another and said front plate, each plate being connected with a respective tension member by a clevis.

6. In a rectilinear structure formed from structural members, diagonal tension members for resisting racking of the structure due to transverse loads, and connectors joining the diagonal tension members to the structural members, the improvement wherein each of said connectors comprises a resilient element maintained in compression at least in part by tension in a respective tension member, and mounted against a surface of one of the structural members, opposite from the diagonal tension member, so that said resilient element compresses further under transitory overloading, thereby increasing the deformability of the structure without exceeding the elastic limit of said tension members, and wherein said resilient means is a pad manufactured from an elastomeric material having a thickness of about 1 inch, a durometer hardness of about 70 (type A) at 70° F., a minimum tensile strength of about 3500 psi, and a modulus of about 3.6 ksi at 55° F.

7. The invention of claim 6, wherein said elastomeric material is selected from the group consisting of natural rubber and neoprene.

8. A connector for joining a diagonal reinforcing rod to a structural member, comprising a bracket having means for connecting the bracket to one end of the reinforcing rod, a resilient pad, and a backing plate for compressing said pad, said bracket, said plate, said pad and said structural member having corresponding holes for receiving fasteners to support the bracket on one side of the structural element, and the pad and plate on the opposite side thereof.

* * * * *